US007537306B2

(12) United States Patent
Mizutani

(10) Patent No.: US 7,537,306 B2
(45) Date of Patent: May 26, 2009

(54) INK JET PRINTING METHOD AND INK JET PRINTING APPARATUS

(75) Inventor: Michinari Mizutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/954,903

(22) Filed: Dec. 12, 2007

(65) Prior Publication Data

US 2008/0145068 A1 Jun. 19, 2008

(30) Foreign Application Priority Data

Dec. 19, 2006 (JP) ..... 2006-341387

(51) Int. Cl.
*B41J 29/393* (2006.01)

(52) U.S. Cl. ..... 347/19; 347/14

(58) Field of Classification Search ..... 347/14, 347/15, 19, 41, 43; 358/1.2, 1.9
See application file for complete search history.

(56) References Cited

U.S. PATENT DOCUMENTS 6,007,182 A 12/1999 Matsubara et al.
6,814,422 B2 * 11/2004 Bruch et al. ..... 347/23
7,289,246 B2 * 10/2007 Takahashi et al. ..... 358/1.9
2002/0140756 A1 * 10/2002 Kuriyama et al. ..... 347/19

FOREIGN PATENT DOCUMENTS

| | | |
|---|---|---|
| JP | 55-065269 | 5/1980 |
| JP | 55-066976 | 5/1980 |
| JP | 64-63185 | 3/1989 |
| JP | 6-087222 | 3/1994 |
| JP | 9-020070 | 1/1997 |
| JP | 9-025442 | 1/1997 |

* cited by examiner

*Primary Examiner*—Lamson D Nguyen
(74) *Attorney, Agent, or Firm*—Fitzpatrick, Cella, Harper & Scinto

(57) ABSTRACT

A color ink jet printing apparatus is provided which can print high quality color images and black letters without increasing a running cost and a printing time while using nozzle arrays with poor first ejection stability. For this purpose, inks with good first ejection stability are printed overlappingly at those of pixel positions printed by another nozzle array where the first ejection stability problem is likely to be caused by the latter nozzle array ejecting an ink with poor first ejection stability. This makes the first ejection stability problem less conspicuous on a printed image while taking full advantage of desirable characteristics of the inks used.

11 Claims, 9 Drawing Sheets

| NOZZLE ID | NUMBER OF SCANS DURING WHICH NO EJECTIONS HAVE BEEN EXECUTED |
|---|---|
| NOZZLE 1 | 3 |
| NOZZLE 2 | 1 |
| NOZZLE 3 | 5 |
| NOZZLE 4 | 0 |
| ⋮ | ⋮ |

| NOZZLE ID | NUMBER OF SCANS DURING WHICH NO EJECTIONS HAVE BEEN EXECUTED |
|---|---|
| NOZZLE 1 | 3 |
| NOZZLE 2 | 1 |
| NOZZLE 3 | 5 |
| NOZZLE 4 | 0 |
| ⋮ | ⋮ |

FIG.5

INK JET PRINTING METHOD AND INK JET PRINTING APPARATUS

BACKGROUND OF THE INVENTION

1. Field of the Invention

The present invention relates to an ink jet printing method for forming an image on a print medium by ejecting ink onto it. More specifically, it relates to a printing method for an ink jet printing apparatus that prints an image using a plurality of inks with different characteristics.

2. Description of the Related Art

An ink used in conventional ink jet printing apparatus is generally composed of water as a main component and a high boiling point water-miscible solvent, such as glycol, to prevent ink from drying and getting clogged. However, the use of such an ink in printing operation may cause problems of the ink being insufficiently fixed in a print medium or the ink being soaked into the medium unevenly in a certain direction due to an ununiform distribution of loading filler and sizing agent in the surface of the print medium, resulting in a degraded quality of printed images. Further, when a color image is printed using a plurality of color inks, another problem has been observed in which inks of different colors come into contact and mix with one another before being soaked into the medium, rendering boundary sections between different colors in a printed image blurred. In the following description, such an ink mixing or spreading at the boundary sections is referred to as "bleeding."

To address these problems printing apparatus incorporating a fixing device are being provided. By passing a print medium through the fixing device immediately after printing, printed ink can be quickly dried and prevented from bleeding. The printing apparatus with a built-in fixing device, however, becomes large in size, increasing the manufacturing cost. Further, since two steps—printing and fixing—are required, an image output speed decreases.

In light of this problem, rather than incorporating a new device such as the fixing device, a new method is being adopted frequently which makes improvements on the ink itself to solve the fixing and bleeding problems. For example, Japanese Patent Laid-Open No. 55-66976 discloses an ink mainly composed of a volatile solvent. Since a volatile ink quickly dries upon landing on a print medium, bleeding does not easily occur. This ink, however, may cause a new problem of ink clogging because the volatile ink easily evaporates from ejection openings in a print head that accommodates the ink.

Japanese Patent Laid-Open No. 55-65269 discloses an ink containing a compound that enhances a penetration of ink, such as surfactant. An ink with high permeability can soak into a print medium quickly upon landing, thus preventing contact among inks of different colors on the print medium and making their bleeding less likely. Since this ink is not volatile as is the ink of Japanese Patent Laid-Open No. 55-66976, there is no fear of an ink clogging problem caused by evaporation. Therefore, a growing number of color ink jet printing apparatus in recent years are using an ink with high permeability, such as disclosed in Japanese Patent Laid-Open No. 55-65269, because it can be handled relatively easily while reliably alleviating the problem of fixing and bleeding.

However, since the ink with high permeability also has its colorant soak deep into the print medium, there is a drawback that an image density and color saturation on the print medium surface tend to be lower than those of the conventional inks. Further, since ink tends to penetrate along fibers of the print medium, line arts such as characters can lose sharpness, rendering a so-called feathering more noticeable. That is, an ink characteristic tending to increase a fixing performance and avoid bleeding and an ink characteristic tending to increase an image density and suppress feathering are incompatible with each other. That is, these two opposing characteristics are difficult to achieve at one time with one kind of ink.

In recent years therefore, a printing construction and a printing method have been proposed and implemented in which a plurality of inks with different characteristics are incorporated in the same printing apparatus, with ink permeability differentiated for instance between a black ink often used to print letters and color inks often used to print graphics and picture images.

Japanese Patent Laid-Open No. 64-63185, for example, discloses a technique in which an ink jet print head to eject a liquid compound for making a dye contained in ink insoluble is prepared and in which the compound and ink are mixed on a print medium. Further, Japanese Patent Laid-Open Nos. 9-020070 and 9-025442 disclose a method in which a component for insolubilizing a black ink is contained in a particular color ink and in which the color ink that reacts with the black ink is printed where the black ink is to be printed.

Further, Japanese Patent Laid-Open No. 6-87222 discloses a method that prints boundary sections between color images and black images with a black that is produced by mixing color inks, in order to avoid bleeding between a black ink with low permeability and color inks with high permeability.

Also available in the market in recent years is an ink jet printing apparatus that uses two kinds of black ink—a black ink to emphasize the print quality of black letters and a black ink to emphasize the print quality of smooth photographic images.

A black ink emphasizing the print quality of black letters often has a higher content of colorant than other colors or uses a pigment with higher coagulation characteristic as a colorant to realize a higher density. When such an ink is used with an ink jet print head having fine nozzles to eject as small an ink droplet as possible, the ink at a front end of the nozzle tends to increase its viscosity as a solvent evaporates. In descriptions that follow, ink whose viscosity has increased as the result of solvent evaporation is called a viscous ink. The viscous ink is more difficult to eject if applied the same energy and the direction and speed of ejected viscous ink droplets are unstable, often resulting in shifted dot landing positions and loss of dots on a print medium. It is noted, however, that since the ink viscosity begins to increase only after the evaporation from the nozzle openings has proceeded to some extent, the viscosity increase does not occur easily with the nozzles that continuously eject ink. It is also noted that if the ink becomes viscous, the ink ejection state often returns to normal after a few unstable ejections are performed. That is, a first ejection from a nozzle that has not performed an ejection operation for some time is influenced by an extent to which the ink becomes viscous. A stability of the first ink ejection from such a nozzle is referred to as first ejection stability in this specification.

It is true that even if the first ejection stability is bad, the quality of printed image can be kept normal to some extent by periodically making a preliminary ink ejection from a nozzle. However, performing the preliminary ejection requires moving a carriage mounting the print head to a position where the preliminary ejection can be done, i.e., to a predetermined position outside a print medium, which in turn takes an extra time in addition to a real printing time. Depending on a combination of ink and a high-precision print head of recent years or on a size of print medium, there are cases where a deteriorated first ejection stability is observed even during one printing scan of the carriage and the effect of the preliminary ejection does not last for one complete printing scan. Further, the frequent preliminary ejection is not desirable because many preliminary ejection operations can consume a considerable volume of ink for other than printing, increasing a running cost.

SUMMARY OF THE INVENTION

The present invention has been accomplished to solve the above problems. It is therefore an object of this invention to provide a color ink jet printing apparatus capable of producing high-quality color images and black letters without increasing a running cost or a printing time while using inks and a print head with a degraded first ejection stability.

The first aspect of the present invention is an ink jet printing method which forms an image on a print medium by using at least a first nozzle array for ejecting an ink and a second nozzle array with a better first ejection stability than that of the first nozzle array and by ejecting inks according to image data, the ink jet printing method comprising the steps of: acquiring information on a non-ejection time for each of nozzles included in the first nozzle array; generating ejection data to cause associated nozzles included in the second nozzle array to eject an ink according to the information on the non-ejection time for each nozzle; and ejecting the ink from the second nozzle array according to the ejection data.

The second aspect of the present invention is an ink jet printing method which forms a color image on a print medium by using at least a black nozzle array for ejecting a black ink and a plurality of color nozzle arrays for ejecting different color inks with a better first ejection stability than that of the black nozzle array and by ejecting inks according to image data, the ink jet printing method comprising the steps of: acquiring information on a non-ejection time for each of nozzles included in the black nozzle array; generating ejection data to cause associated nozzles included in the color nozzle arrays to eject inks according to the information on the non-ejection time for each nozzle; and ejecting the inks from the color nozzle arrays according to the ejection data.

The third aspect of the present invention is an ink jet printing apparatus which forms an image on a print medium by using at least a first nozzle array for ejecting an ink and a second nozzle array with a better first ejection stability than that of the first nozzle array and by ejecting inks according to image data, the ink jet printing apparatus comprising: a means to acquire information acquiring unit that acquires an information on a non-ejection time for each of nozzles included in the first nozzle array; a means to generate ejection data generation unit that generates ejection data to cause associated nozzles included in the second nozzle array to eject an ink according to the information on the non-ejection time for each nozzle; and ejection unit that a means to ejects the ink from the second nozzle array according to the ejection data.

Further features of the present invention will become apparent from the following description of exemplary embodiments (with reference to the attached drawings).

BRIEF DESCRIPTION OF THE DRAWINGS

FIG. 5 is a table showing example information on nozzle ejections;

DESCRIPTION OF THE EMBODIMENTS

Now, embodiments of this invention will be described in detail by referring to the accompanying drawings.

Figure 1:
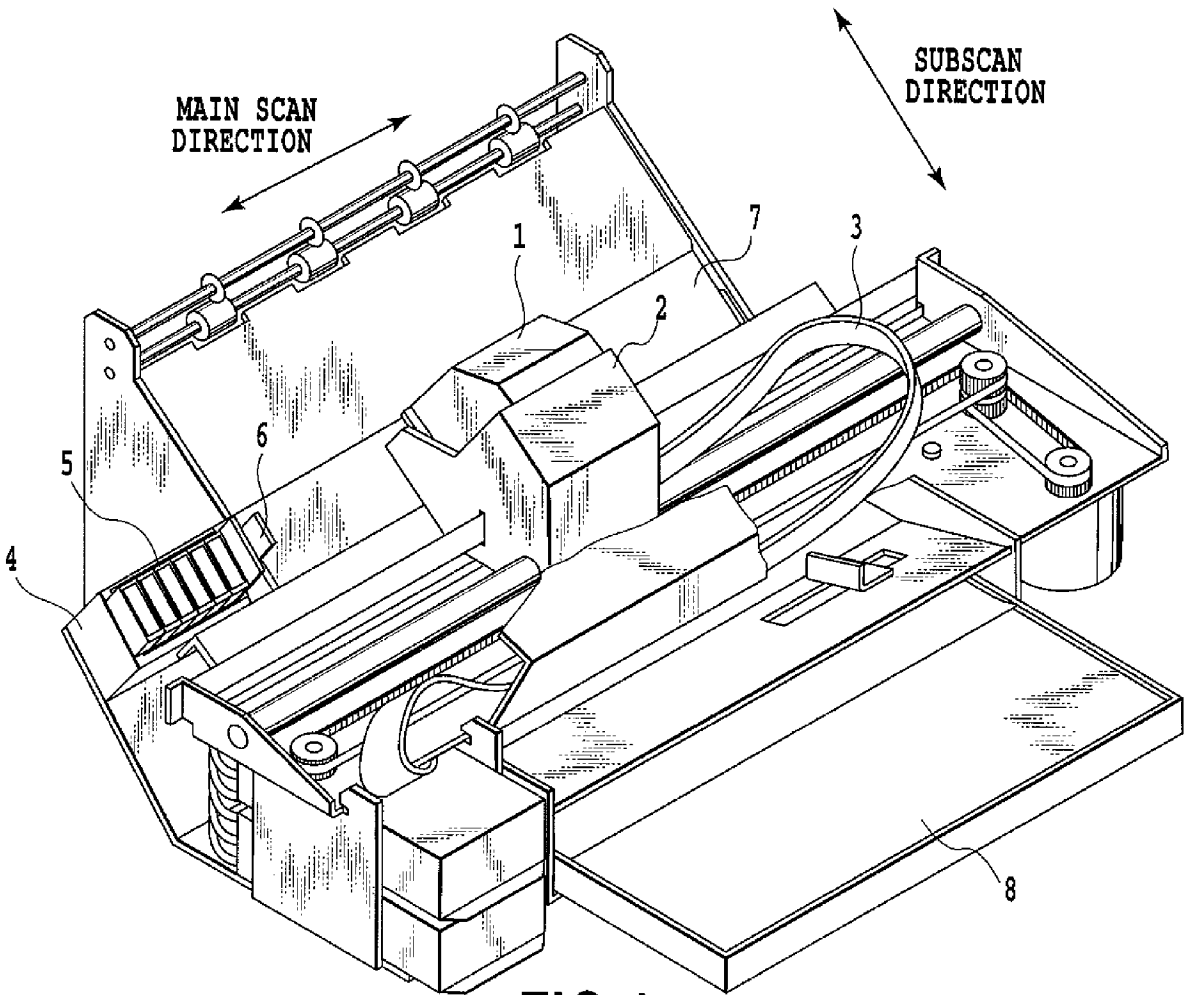
FIG. 1 is a perspective view showing an outline construction of an ink jet printing apparatus that can apply the present invention.

FIG. 1 is a perspective view showing an outline construction of an ink jet printing apparatus that can apply the present invention. A carriage 2 mounts a print head 1 having a plurality of nozzle arrays to eject a plurality of color inks and can be reciprocally moved in a main scan direction as shown in the figure. A flexible cable 3 connects a printed circuit board installed in the printing apparatus body to a printed circuit board installed in the carriage 2 such that the flexible cable 3 can follow the reciprocal motion of the carriage 2.

When a printing operation is started, one of print medium 7 sheets stacked on a paper tray 8 is supplied in a subscan direction to an area where it can be printed on by the print head 1. Then, as the carriage 2 is moved in a main scan direction, individual nozzles in the print head eject ink according to a signal supplied through the flexible cable 3 to form dots on the print medium 7. After one line of the printing main scan is completed, the print medium 7 is fed a predetermined distance in the subscan direction. With the printing main scan operation and the subscan operation repetitively alternated as described above, an image is progressively formed on the print medium 7.

A recovery means 4 to maintain the print head 1 is installed in a path of the carriage 2 but outside the printing area for the print medium. The recovery means 4 includes a cap unit 5 for forcibly sucking out ink from individual ejection openings of the print head and for receiving ink that is ejected during a preliminary ejection, and a wiper blade 6 to wipe an ejection opening face clean.

Figure 2:
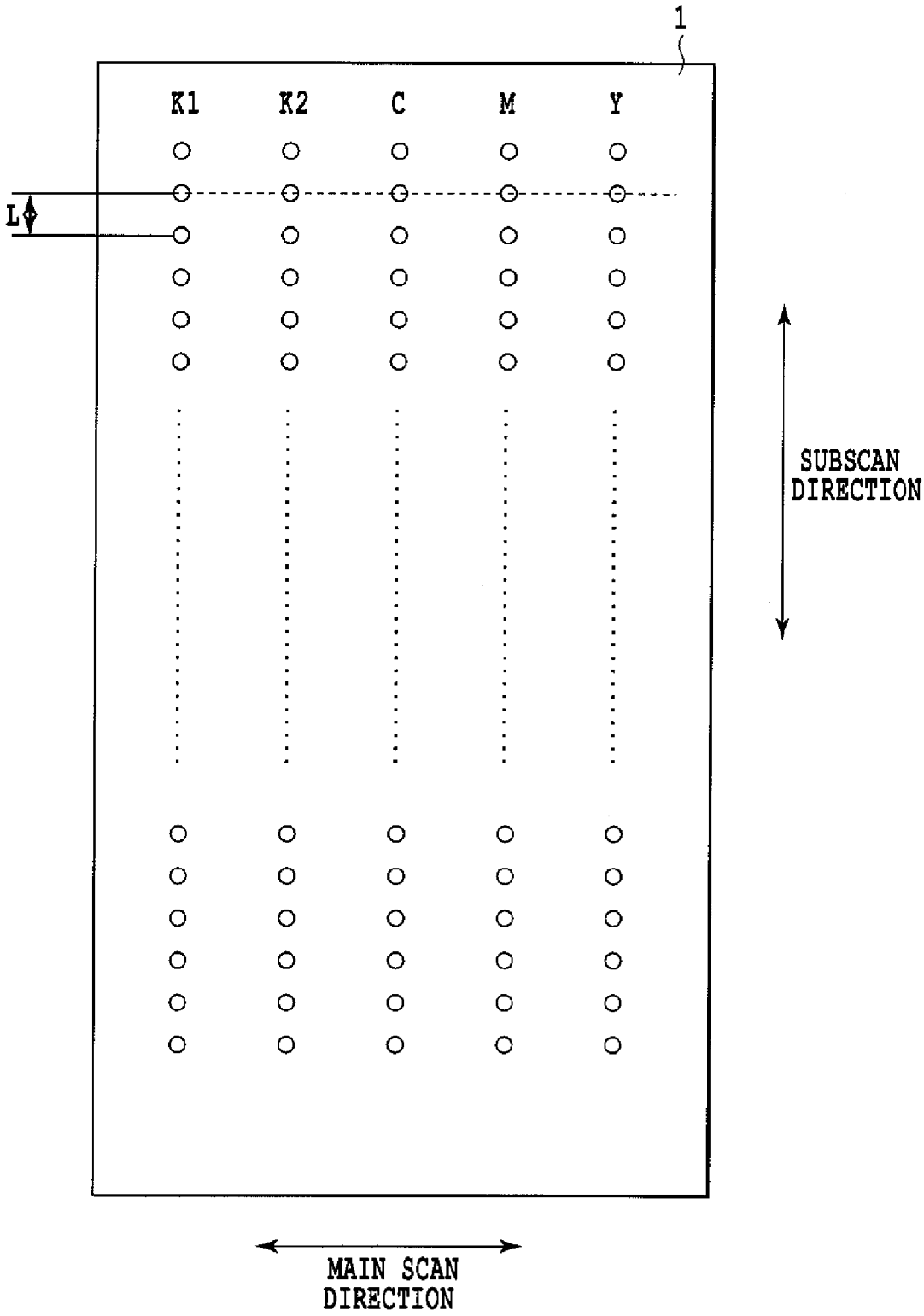
FIG. 2 is a schematic diagram showing arrays of ejection openings in an ink jet print head used in a first embodiment of this invention.

FIG. 2 is a schematic diagram showing arrays of ejection openings formed in the ink jet print head 1 applied in this embodiment. In this embodiment, five color nozzle arrays capable of ejecting a first black ink K1, a second black ink K2, a cyan ink C, a magenta ink M and a yellow ink Y are arranged as shown. Each nozzle array comprises 512 ejection openings arranged in the subscan direction at intervals of L=42.3 μm, each capable of ejecting approximately 10 ng of ink. Thus, by causing the print head 1 to eject ink as it travels in the main scan direction, a strip of image 2.2 cm high in the subscan direction can be printed at a resolution of 600 dpi (dots/inch) in the subscan direction.

In this embodiment, the first black ink and three color inks including a dye as a colorant and relatively large amount of surfactant, have high permeability and low coagulation. On the other hand, the second black ink including a pigment as a colorant has low permeability and high coagulation. Then, the first black ink and three color inks are used in case that an image such as graphic or photograph is printed, and the second black ink is used in case that an image such as line art or black letter is printed.

Figure 3:
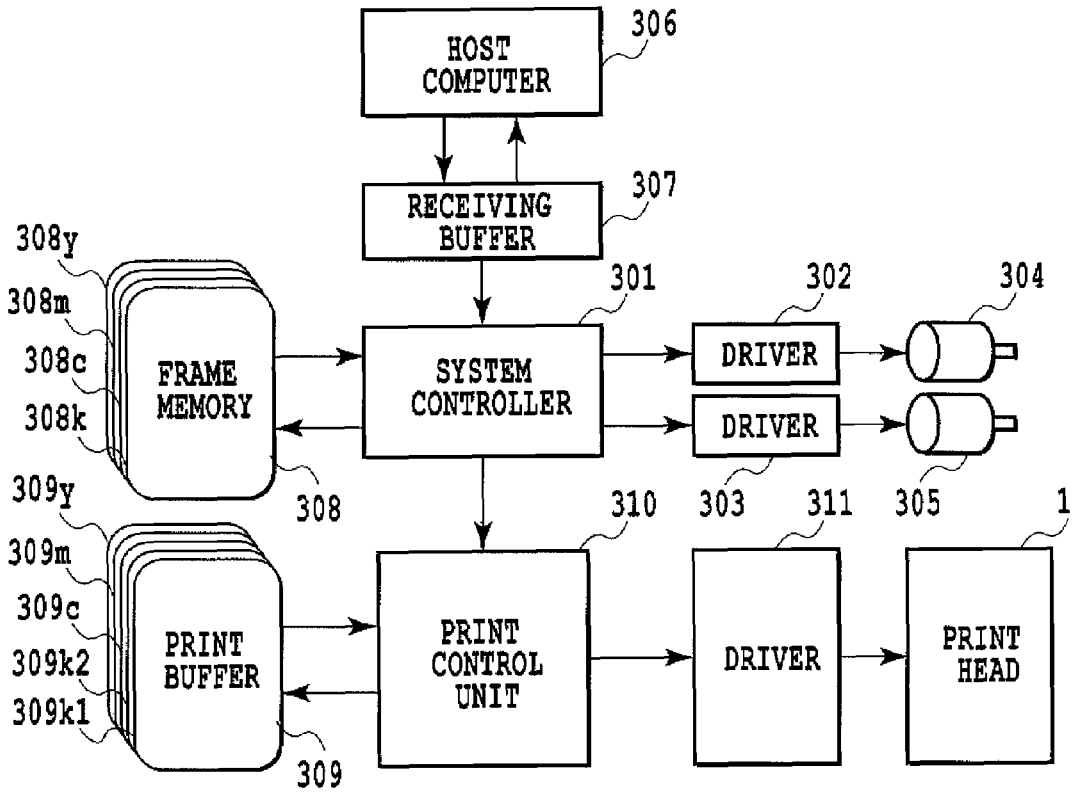
FIG. 3 is a block diagram showing a configuration of a control system in the ink jet printing apparatus applicable to the embodiment of this invention.

FIG. 3 is a block diagram showing a configuration of a control system in the ink jet printing apparatus according to this embodiment. Denoted 301 is a system controller to control the printing apparatus as a whole. It incorporates a microprocessor, a memory (ROM) in which a control program is stored, and a memory (RAM) used by the microprocessor during processing. Designated 302 is a driver to activate a carriage motor 304 that drives the carriage 2 in the main scan direction. Denoted 303 is a driver to activate a feed motor 305 that feeds the print medium 7 in the subscan direction. Denoted 306 is a host computer externally connected to the printing apparatus to transfer print information through a receiving buffer 307 to the printing apparatus.

Denoted 308 is a frame memory in which image data to be printed is developed into print data and which has an enough memory size for printing. In this embodiment the frame memory large enough to store one print medium page of image is prepared but this invention is not limited to a particular size of the frame memory. Denoted 309 is a memory device to temporarily store image data to be printed. This memory device 309 has a print buffer for first black 309K1 and a print buffer for second black 309K2, and print buffers for colors 309C, 309M, 309Y. These buffers have enough capacities to enable all nozzles of the print head 1 to print one line of image data.

Denoted 310 is a print control unit that controls the print head 1 in response to instructions from the system controller 301. The print control unit 310 also generates a first black image and a second black image from a black image stored in the frame memory 308K and stores them in the print buffers 309K1, 309K2 respectively.

Image data of various colors stored in the print buffer 309 is transferred to a driver 311 that is controlled by the print control unit 310 to drive the print head 1.

Figure 4:
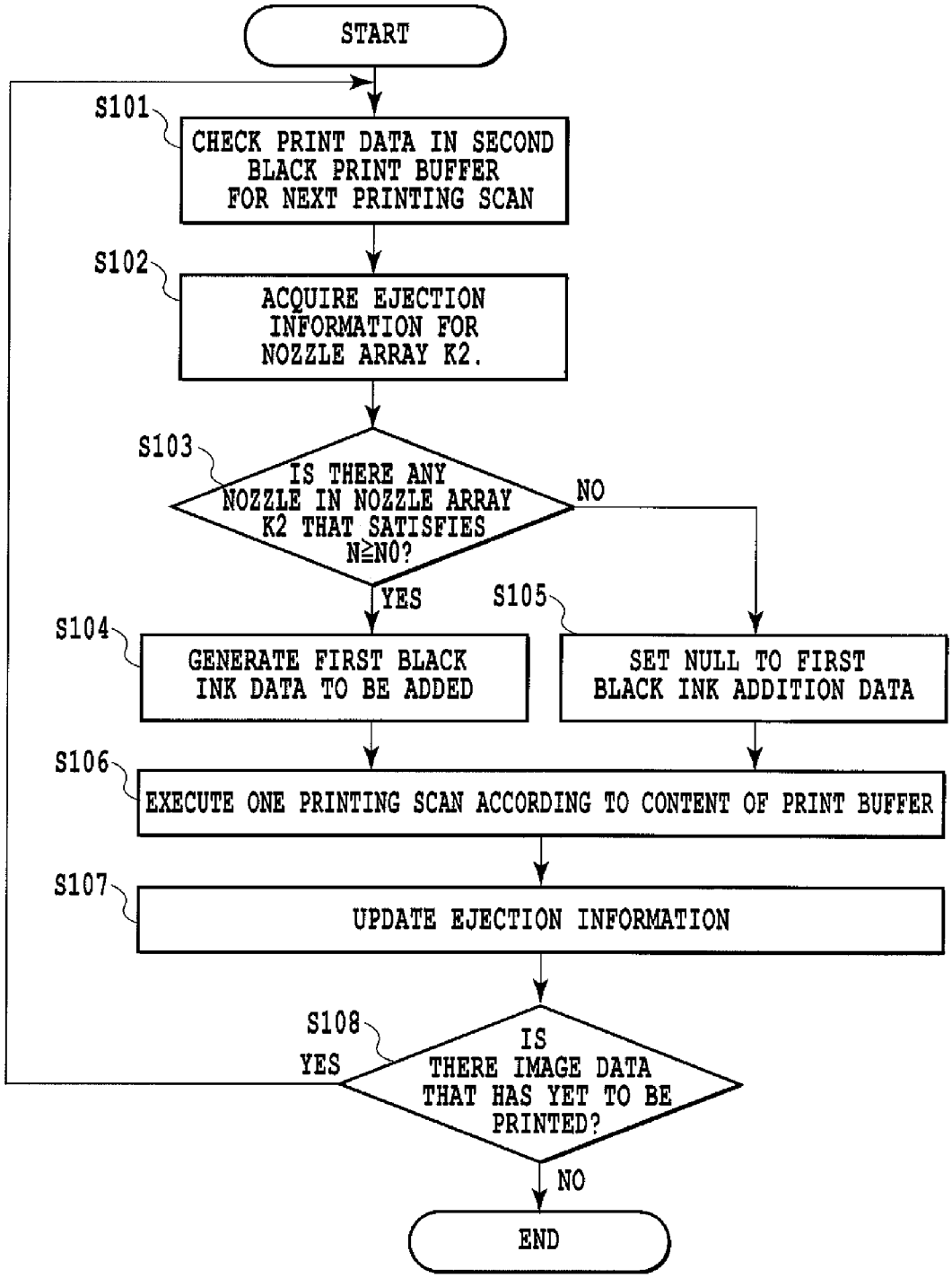
FIG. 4 is a flow chart showing a sequence of steps performed by a print controller when the ink jet printing apparatus according to the first embodiment prints one page of image.

FIG. 4 is a flow chart showing a sequence of steps executed by the print control unit 310 when the ink jet printing apparatus of this embodiment prints one page of image. Here we take up as an example a 1-pass printing in which an image is formed by one printing scan of the print head over the same image area of the print medium.

In step S101 the print control unit 310 checks the print buffer 309K2 for second black K2 and retrieves image data to be printed. At step S102 the print control unit 310 retrieves ejection information on individual nozzles of a nozzle array K2. This information is stored in a memory of the system controller 301.

FIG. 5 shows an example of ejection information retrieved by step S102. In the figure, a left-hand-side column represents individual nozzle ID numbers of the nozzles in the second black nozzle array K2 and a right-hand-side column represents the number of printing scans (N) that the nozzle of interest has not performed ejection since the last ejection. The number of scans (N) is stored in the memory of the printing apparatus and is updated each time the printing scan is executed. For example, if an ejection operation is performed even once during a printing scan, the number of scans (N) is reset to 0. If not a single ejection operation has been performed, the number of scans (N) is incremented by one after each scan. An approximate time that individual nozzles have not performed the ejection operation can be known from the number of scans (N). So, based on the information retrieved by step S102, the first ejection stability of individual nozzles can be determined.

Step S103 checks if there is any nozzle among the 512 nozzles in the second black K2 nozzle array that has not performed the ejection operation at all for a predetermined number of scans NO or more, i.e., if there is any nozzle whose scan number N is N≧N0. Here the scan number N0 represents the number of scans during which the nozzle of interest has not performed even a single ejection and beyond which the nozzle will no longer be able to perform a normal ejection (i.e., a threshold number of scans). If it is determined that there is a nozzle in the second black K2 array that satisfies N≧N0, the print control unit 310 moves to step S104 where it generates in the first black print buffer 309K1 print data (1) for those pixels that the nozzle of second black K2 in question is to print, in order that the first black K1 is also printed superimposed on a part of the pixels that are to be printed by that K2 nozzle. If on the other hand it is determined that there is no K2 nozzle that satisfies N≧N0, the print control unit 310 moves to step S105 where it sets null (0) in the first black K1 print data for the pixels that are to be printed by the second black nozzles.

Figure 6A:
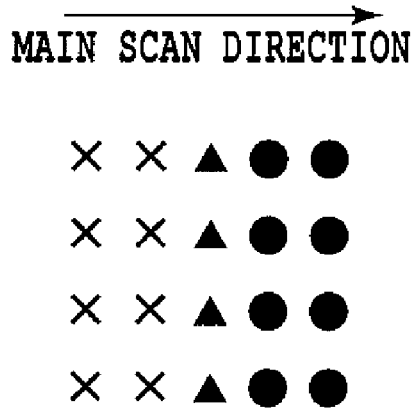
FIGS. 6A to 6C are schematic diagrams showing print data for a newly generated first black.
Figure 6B:
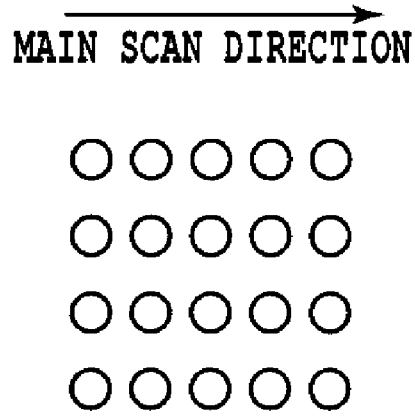
Figure 6C:
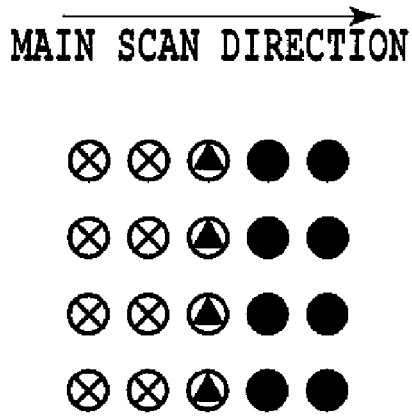

FIGS. 6A to 6C are schematic diagrams showing print data for first black generated at step S104. FIG. 6A is a schematic diagram showing a first ejection state of the second black K2 nozzles when their number of scans N is N≧N0. Here is shown a dot landing state when four nozzles arranged close together in the subscan direction perform five ejections in succession as they move in the main scan direction. Positions of marks black circle ●, x and black triangle ▲ correspond locations where dots are formed by the associated nozzles. The black circle ● represents a state in which a dot is printed normally, x represents a state in which a dot is not printed, and the black triangle ▲ represents a state in which a faulty dot is formed. In the figure, all the four nozzles are shown to have not executed first and second ejection, to have executed a third ejection though in a faulty state, and to have printed normal dots at the fourth and subsequent ejection. Although in the example shown normal dots are formed at the fourth and succeeding ejection, studies conducted by the inventors of this invention have found that the problem of the first ejection stability with commonly used inks can be solved after a successive ejection of a few to several tens of ink droplets.

FIG. 6B shows a first ejection state of the first black nozzles under the same condition as FIG. 6A. The first black ink used in this embodiment has a lower coagulation tendency than the second black ink. So, the first black nozzles, if left at rest for the same period of time, are less likely to cause a coagulation of colorant than the second black nozzles and thus can maintain a good first ejection stability. As a result, the first black nozzles form normal dots from the first ejection, as shown by white circles ○.

The inventors of this invention have decided that it is effective in producing high quality images to take advantage of characteristic differences among different inks described above and execute control so as to eject an ink with good first ejection stability also to positions of a first few dots of an ink with bad first ejection stability. That is, as shown in FIG. 6C, data of first black ink is printed superimposed on first three pixels where dots of second black ink should be formed, thus making the problem of first ejection stability of the second black ink less distinctive on a printed image. It is noted, however, that after the ejection of the second black ink becomes normal, the superimposed printing of the first black ink is no longer performed, in order to take full advantage of the characteristics of the second black ink of high density and little feathering tendency.

Returning again to the flow chart of FIG. 4, step S106 executes one printing scan according to the print buffer 309 in which final print data was stored by step S104 or step S105.

The next step S107 updates ejection information of nozzles explained with reference to FIG. 5. More specifically, the number of scans (N) for those nozzles that have performed even a single ejection operation during the current printing scan is reset to 0. The number of scans (N) for those nozzles that have not performed ejection at all is incremented by 1.

Step S108 checks if any data still remains in the frame memory 308 that needs to be printed in the next printing scan. If it is decided that there is data that has yet to be printed, the print control unit 310 returns to step S101 where it repeats the above sequence of steps in the next printing scan. If, however, no data to be printed in the next printing scan is found, this processing is exited.

With the above embodiment, as described above, a first black ink, which has the same color as a second black ink but different characteristics of a low coagulation tendency and a good first ejection stability, is printed superimposed over the second black ink only at those print positions of the second black ink where the first ejection stability problem is likely to be caused by the second black ink that has a high coagulation tendency and a poor first ejection stability. This makes the first ejection stability problem less noticeable on a printed image while taking full advantage of the good characteristic of the second black ink of high coagulation tendency.

In the above explanation, the first black ink having good first ejection stability is ejected to print positions of the second black ink without distinguishing between the position where a dot is not printed (x) and the position where a faulty dot is formed (▲). By providing a drive controller which modulate driving signals for nozzles, however, an ejection volume of the first black ink having good first ejection stability may be adjusted so that the ejection volume for the position of x is larger than that for the position of ▲. The method of adjusting the ejection volume of the ink may include a method in which a width of pre-pulse is modulated in case that a driving pulse consists of the pre-pulse and a main pulse, and a method in which a driving voltage is modulated in case of single-pulse driving system. The positions where a dot is not printed (x) and a faulty dot is formed (▲) can be previously obtained by way of experiment. Then the ejection volume of the first ink having good first ejection stability for the position of x may be adjusted so as to be larger than that for the position of ▲, when the number of printing scans (N) in a condition that the nozzles of interest have not performed ejection reaches the threshold number. However, it is not necessary to distinguish between the position of x and the position of ▲ distinctly. The ejection volume of the first black ink having good first ejection stability may be adjusted so that the ejection volume for a predetermined number of ejections performed from a first ejection is larger than that for other ejection.

In the above explanation, the first black ink has been described to be used only at those print positions where the second black ink is likely to cause the first ejection stability problem. This embodiment of course is not limited to such a configuration. A printing apparatus of this embodiment may employ a configuration which positively uses the first black ink in printing color images such as graphics and photographs and the second black ink in printing black letters and line images. If a control is performed to cause the first black ink to be printed also at those second black ink print positions where the second black ink is feared to cause the first ejection stability problem, a desired effect of this embodiment and the pre-sent invention can be produced.

Second Embodiment

Now, a second embodiment of this invention will be explained. This embodiment also uses an ink jet printing apparatus of the construction explained in FIGS. 1 and 3. It is noted, however, that a print head of this embodiment has a construction different from that of the preceding embodiment and that the number of planes in the frame memory 308 and the print buffer 309 is therefore adjusted accordingly.

Figure 7:
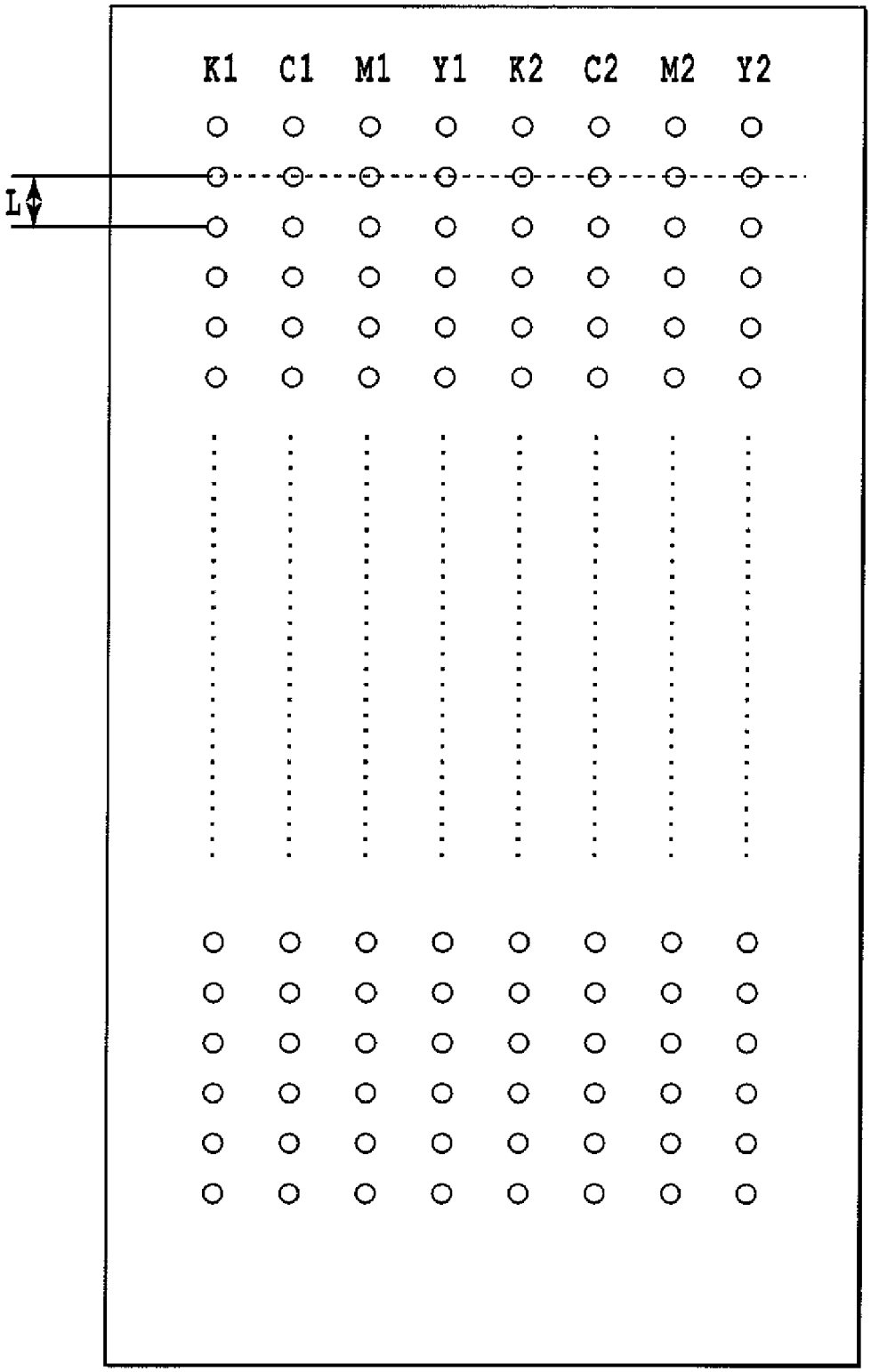
FIG. 7 is a schematic diagram showing arrays of ejection openings in an ink jet print head used in a second embodiment of this invention.

FIG. 7 is a schematic diagram showing arrays of ejection openings or nozzles in the ink jet print head applied in this embodiment. In this embodiment a first and a second ink are prepared for each ink color—black, cyan, magenta and yellow—and a total of eight arrays of nozzles are formed as shown. In each nozzle array, 512 ejection openings, each capable of ejecting about 10 ng of ink, are arranged in the subscan direction at intervals of L=42.3 μm, as in the first embodiment.

In this embodiment, first inks—black K1, cyan C1, magenta M1 and yellow Y1—use dyes as colorants, contain a relatively large amount of surfactant and have a relatively high permeability and a low coagulation tendency. The second inks—black K2, cyan C2, magenta M2 and yellow Y2—use pigments as colorants and have a relatively low permeability and a high coagulation tendency.

Although the first embodiment has generated, only for black, print data of an ink with good first ejection stability for superimposed printing on a part of pixels that are to be printed with an ink with poor first ejection stability, the second embodiment performs this same processing for all four colors. That is, at step S101 in FIG. 4 the print control unit 310 checks the print buffer 309 for second cyan C2, second magenta M2 and second yellow Y2 as well as second black K2. Then at step S102 it retrieves ejection information for all nozzles in the second nozzle arrays K2, C2, M2 and Y2. Then step S103 to step S105 are executed for each of the colors and, at step S106, the printing scan is performed according to all eight planes of the print buffer 309 (K1, K2, C1, C2, M1, M2, Y1, Y2).

With this embodiment, therefore, images with excellent color saturation and crispness and with good anti-bleeding performance can be produced in colors as well as in black.

Third Embodiment

Now, a third embodiment of this invention will be explained. It is assumed that this embodiment also uses an ink jet printing apparatus of the same construction as those of the preceding embodiments explained with reference to FIGS. 1 and 3.

Figure 8:
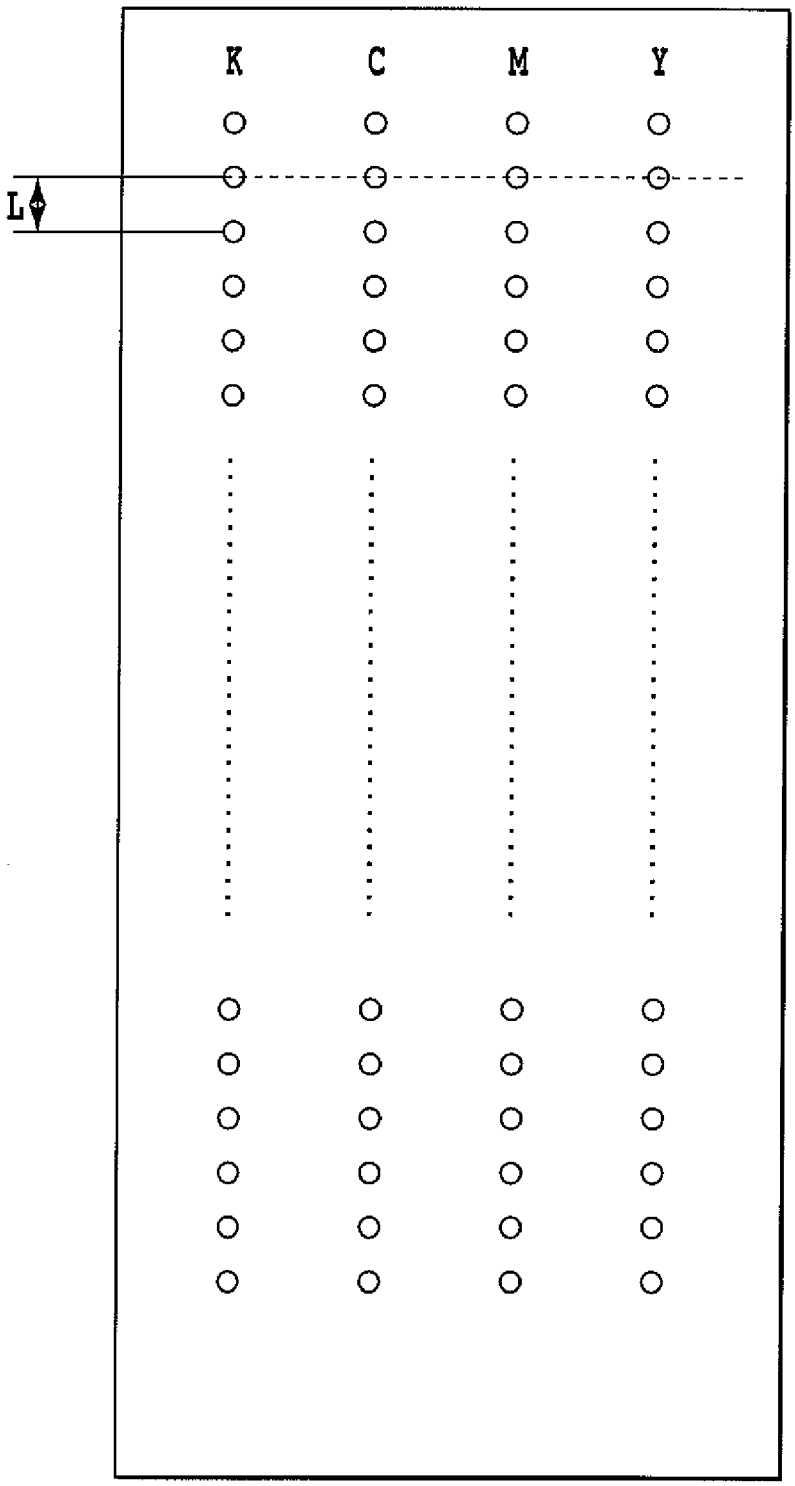
FIG. 8 is a schematic diagram showing arrays of ejection openings in an ink jet print head used in a third embodiment of this invention.

FIG. 8 is a schematic diagram showing how ejection openings are arranged in an ink jet print head applied in this embodiment. In this embodiment one kind of ink is provided for each of the colors—black, cyan, magenta and yellow—and a total of four nozzle arrays are arranged as shown. Each of these nozzle arrays comprises 512 ejection openings arranged in the subscan direction at intervals of L=42.3 μm, each capable of ejecting approximately 10 ng of ink, as in the first embodiment.

In this embodiment, cyan C, magenta M and yellow Y inks use dyes as colorants, contain a relatively large amount of surfactant and have a relatively high permeability and a low coagulation tendency. The black ink K, on the other hand, uses a pigment as a colorant and has a relatively low permeability and a high coagulation tendency.

In this embodiment, cyan, magenta and yellow inks are printed overlappingly at print positions where the black ink is likely to cause the first ejection stability problem, to produce a black by the mixing of these color inks.

Figure 9:
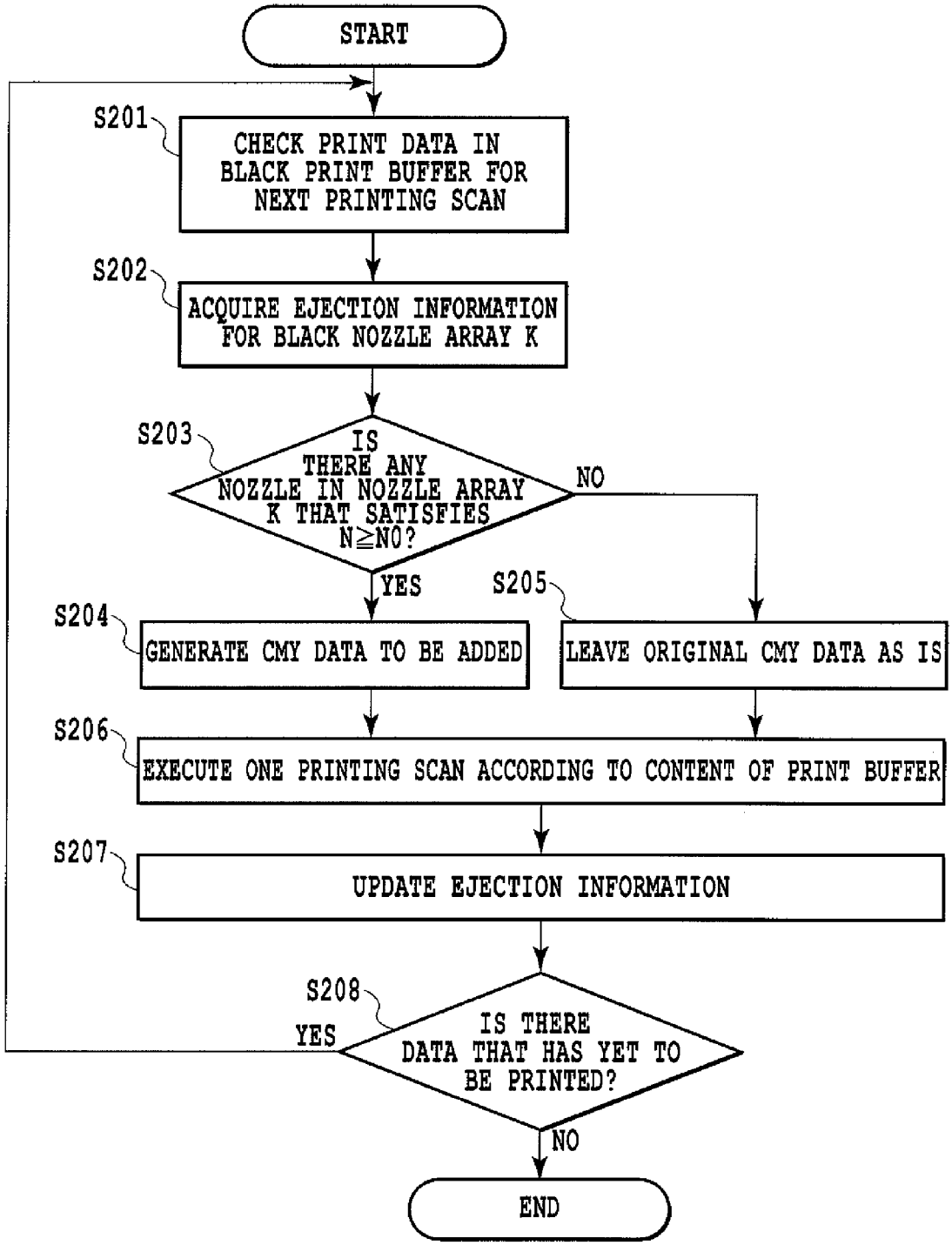
FIG. 9 is a flow chart showing, in comparison with FIG. 4, a sequence of steps performed by a print controller when the ink jet printing apparatus according to the third embodiment prints one page of image.

FIG. 9 is a flow chart showing, in comparison with FIG. 4, a sequence of steps executed by the print control unit 310 in printing one page of image in the ink jet printing apparatus of this embodiment. In step S201 the print control unit 310 checks the print buffer 309K for black K and acquires image data to be printed. In the next step S202 the print control unit 310 retrieves ejection information for individual nozzles in the nozzle array K.

Step S203 checks if, among the 512 nozzles in the black K nozzle array, there is any nozzle that has not performed an ejection operation at all for more than a predetermined number of scans NO, i.e., whose scan number N is N≧N0. If it is decided that there is a nozzle with N≧N0, the print control unit 310 moves to step S204 where it creates print data (1) in individual color print buffers 309C, 309M, 309Y. If no nozzle with N≧N0 is found, the print control unit 310 proceeds to step S205 where it leaves the original CMY data as is, without creating new CMY print data that will be printed at part of those pixels at which the black nozzles are to print a black ink.

Step S206 executes one printing scan according to the print buffer 309 in which final print data is stored by step S204 or step S205.

At the next step S207, the ejection information for the black nozzles is updated. That is, the number of scans (N) for those nozzles that have performed even a single ejection operation during the current printing scan is reset to 0. For those nozzles that have not performed ejection at all, the number of scans (N) is incremented by one.

Step S208 checks if data that needs to be printed in the next printing scan still remains in the frame memory 308. If it is decided that data to be printed still remains, the print control unit 310 returns to step S201 where it repeats the above sequence of steps in the next printing scan. If no data to be printed in the next printing scan is found, this processing is exited.

As described above, in this embodiment, color inks with low coagulation tendency and therefore good first ejection stability are printed overlapping at only those of the black ink print positions where the first ejection stability problem is likely to be caused by the black ink with high coagulation tendency and therefore bad first ejection stability. This makes the first ejection stability problem of the black ink less noticeable on the printed image while at the same time taking full advantage of the desirable characteristic of the black ink of high coagulation tendency.

If there are some positions where one of color inks is printed on with black ink being likely to cause the first ejection stability problem, print data of other color inks may be created so that other color inks are printed together on the position.

In the embodiments described so far, the number of printing scans (N) in which the ejection operation has not been executed at all is stored in a memory of the printing apparatus for each nozzle. The present invention is not limited to this configuration. The first ejection stability is directly influenced by the time during which individual nozzles have not performed ejections, or non-ejection time, so whatever parameters can take the place of the non-ejection time (information on the non-ejection time) can be used. For example, the number of successive pixels that the individual nozzles have not printed on may be counted and, only if it exceeds a predetermined count, may a control be performed to cause the first black ink to be printed at a first few pixels. This method is particularly effective for a print head that will deteriorate in the first ejection stability in a shorter time than it takes the print head to complete one printing scan.

Where a more precise non-ejection time for individual nozzles needs to be acquired, it may be calculated by using print data and a drive frequency. For example, if there are null data on 10,000 pixels in succession for a nozzle whose drive frequency is 20 kHz, the non-ejection time for that nozzle is 1 second/20,000 Hz×10,000 pixels=0.5 seconds. A single printing scan includes a carriage reversing time and an acceleration or deceleration time. The times required for these actions may be summed up to manage the non-ejection time more precisely.

Further, the first ejection stability is also influenced by ambient temperature and humidity in addition to the non-ejection time. So, a thermometer/hygrometer may be installed in the printing apparatus to allow information on the temperature and humidity to be taken into account in judging the first ejection stability or in adjusting the number of pixels at which an ink with good first ejection stability is to be printed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2006-341387, filed Dec. 19, 2006, which is hereby incorporated by reference herein in its entirety.

What is claimed is:

1. An ink jet printing method which forms an image on a print medium by using at least a first nozzle array for ejecting an ink and a second nozzle array with a better first ejection stability than that of the first nozzle array and by ejecting inks according to image data, the ink jet printing method comprising the steps of:

acquiring information on a non-ejection time for each of nozzles included in the first nozzle array;

generating ejection data to cause associated nozzles included in the second nozzle array to eject an ink according to the information on the non-ejection time for each nozzle; and ejecting the ink from the second nozzle array according to the ejection data.

2. An ink jet printing method according to claim 1, wherein said ejection data generation step generates the ejection data to cause dots formed by the second nozzle array to overlap a part of dots formed on the print medium by those nozzles of the first nozzle array whose non-ejection time is determined to be greater than a threshold.

3. An ink jet printing method according to claim 1, wherein the first nozzle array ejects an ink with a higher colorant coagulation tendency than that of an ink ejected by the second nozzle array.

4. An ink jet printing method according to claim 1, wherein the first nozzle array ejects an ink containing a pigment and the second nozzle array ejects an ink containing a dye.

5. An ink jet printing method according to claim 1, wherein the first nozzle array and the second nozzle array eject inks of the same color.

6. An ink jet printing method according to claim 5, wherein the first nozzle array and the second nozzle array eject black inks.

7. An ink jet printing method according to claim 1, wherein the first nozzle array ejects a black ink and the second nozzle array ejects a color ink.

8. An ink jet printing method according to claim 1 wherein the image is formed by moving the first nozzle array and the second nozzle array relatively to the print medium, and in said ejection step, each nozzle of the second nozzle array ejects ink with an ejection volume for a predetermined number of ejection operations performed from a first ejection operation of each nozzle being greater than that for other ejection operations.

9. An ink jet printing method which forms a color image on a print medium by using at least a black nozzle array for ejecting a black ink and a plurality of color nozzle arrays for ejecting different color inks with a better first ejection stability than that of the black nozzle array and by ejecting inks according to image data, the ink jet printing method comprising the steps of:

acquiring information on a non-ejection time for each of nozzles included in the black nozzle array;

generating ejection data to cause associated nozzles included in the color nozzle arrays to eject inks according to the information on the non-ejection time for each nozzle; and ejecting the inks from the color nozzle arrays according to the ejection data.

10. An ink jet printing method according to claim 9, wherein the color nozzle arrays eject cyan, magenta and yellow inks containing cyan, magenta and yellow dyes, respectively.

11. An ink jet printing apparatus which forms an image on a print medium by using at least a first nozzle array for ejecting an ink and a second nozzle array with a better first ejection stability than that of the first nozzle array and by ejecting inks according to image data, the ink jet printing apparatus comprising:

an information acquiring unit that acquires information on a non-ejection time for each of nozzles included in the first nozzle array;

an ejection data generation unit that generates ejection data to cause associated nozzles included in the second nozzle array to eject an ink according to the information on the non-ejection time for each nozzle; and an ejection unit that ejects the ink from the second nozzle array according to the ejection data.

* * * * *